US007918509B1

(12) United States Patent
Chen

(10) Patent No.: US 7,918,509 B1
(45) Date of Patent: Apr. 5, 2011

(54) BENCH

(75) Inventor: Yun-Lu Chen, Taipei (TW)

(73) Assignee: Danny Plastics Co., Ltd., Ping-Tung (TW)

( * ) Notice: Subject to any disclaimer, the term of this patent is extended or adjusted under 35 U.S.C. 154(b) by 0 days.

(21) Appl. No.: 12/569,917

(22) Filed: Sep. 30, 2009

(51) Int. Cl.
*A47C 7/00* (2006.01)

(52) U.S. Cl. ..... 297/440.22; 297/440.14

(58) Field of Classification Search ..... 297/440.1, 297/440.14, 440.22, 158.3, 158.5, 452.41
See application file for complete search history.

(56) References Cited

U.S. PATENT DOCUMENTS

| | | | | | |
|---|---|---|---|---|---|
| 2,100,877 | A * | 11/1937 | Severance | 297/452.24 |
| 2,400,167 | A * | 5/1946 | Resnick | 297/182 |
| 3,213,570 | A * | 10/1965 | Abramson, Jr. | 52/8 |
| 3,697,129 | A * | 10/1972 | Sklaar | 297/452.1 |
| D481,211 | S * | 10/2003 | Chipman | D6/349 |
| 6,883,864 | B2 * | 4/2005 | Gregory | 297/158.5 |
| D562,035 | S * | 2/2008 | Pappas | D6/495 |

* cited by examiner

*Primary Examiner* — David Dunn
*Assistant Examiner* — David E Allred
(74) *Attorney, Agent, or Firm* — Alan Kamrath; Kamrath & Associates PA

(57) ABSTRACT

A bench includes at least two feet and two seat plates. Each foot has a sustaining surface in a top thereof and a support frame in a bottom thereof. The seat plate is a rectangular plate. A plurality of protruding blocks is formed to a bottom surface of the seat plate, and a bolt block is embedded in each protruding block. By fastening the feet to the corresponding bolt blocks through holes with bolts, the feet are fixed to the seat plate so as to form a strong and fine bench.

2 Claims, 5 Drawing Sheets

BENCH

FIELD OF THE INVENTION

The present invention relates to a bench and, in particular, to a bench assembled by bolts and several components made of Polypropylene (PP) and Polyethylene (PE). The strong and fine bench is suitable for yard, park, and outdoors.

DESCRIPTION OF THE PRIOR ART

Benches are an usually important element of leisure ambiance providing comfortable relaxation in a public park, square or a private yard. For the consideration of outdoor usage, metals are the most common material since they resist corruption, are heatproof, and are easy to clean. The prior bench has a welded, molded or forged frame body with metal bars as a seat, back, or armrests of the bench. However, the cold appearance of such bench can not fit the surroundings, especially in a park or yard with nature, landscape and plants. Moreover, manufacture is complicated and can not be done by the consumer. Also, the size and weight of the product result in difficulty of transport and assembling.

Furthermore, it is disturbing that most users have to purchase the whole assembly but are unable to transport the assembly by an ordinary vehicle. An easy handling bench is truly a demand for common consumers nowadays.

SUMMARY OF THE PRESENT INVENTION

Accordingly, the primary object of the present invention is to provide a strong and fine bench assembled by bolts and several components made in advance.

To achieve the above object, the present invention provides a bench comprising at least two feet and two seat plates. Each foot and each seat plate are made of Polypropylene (PP) and Polyethylene (PE) and are formed separately. A sustaining surface is formed to a top of the foot, with the sustaining surface inclined downwards from two outer edges towards a center thereof with a predetermined angle. A support frame with two branches is extended from a bottom surface of the sustaining surface. Two enhanced sheets are formed to two sides of the support frame to improve hardness and load capacity of the foot. A plurality of through holes is formed to the sustaining surface. The seat plate is a rectangular plate, with an upper surface of the seat plate being a plane. A plurality of protruding blocks is formed to two ends of a bottom surface of the seat plate. A bolt block with an inner thread is embedded to each protruding block. The bolt blocks match the plurality of through holes of the sustaining surface of the foot. By fastening the bolts through the through holes of the foot to the bolt blocks, the feet and the seat plates are fixed.

DETAILED DESCRIPTION OF THE INVENTION

In order that those skilled in the art can further understand the present invention, a description will be provided in the following in detail. However, these descriptions and the appended drawings are only used to cause those skilled in the art to understand the objects, features, and characteristics of the present invention, but not to be used to confine the scope and spirit of the present invention defined in the appended claims.

Figure 1:
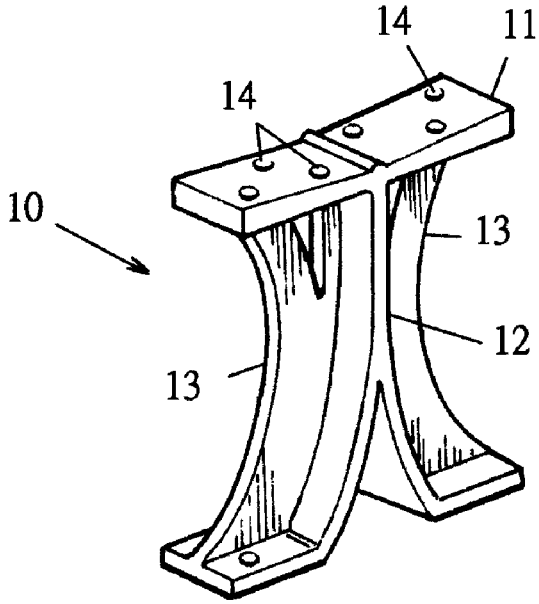
FIG. 1 is a structural perspective view showing a foot of the present invention.

The present invention includes at least two feet 10 and two seat plates 20. Each foot 10 and each seat plate 20 are made of Polypropylene (PP) and Polyethylene (PE) and are formed separately. Referring to FIG. 1, a sustaining surface 11 is formed to a top of the foot 10. The sustaining surface 11 is inclined from two outer edges towards a center thereof. The inclined angle is preferably between 2 to 8 degrees. A support frame 12 with two branches is extended from a bottom surface of the sustaining surface 11. Two enhanced sheets 13 are formed to two sides of the support frame 12 to improve the hardness and the load capacity of the foot 10. A plurality of through holes 14 are formed in the sustaining surface 11 and the support frame 12.

Figure 2:
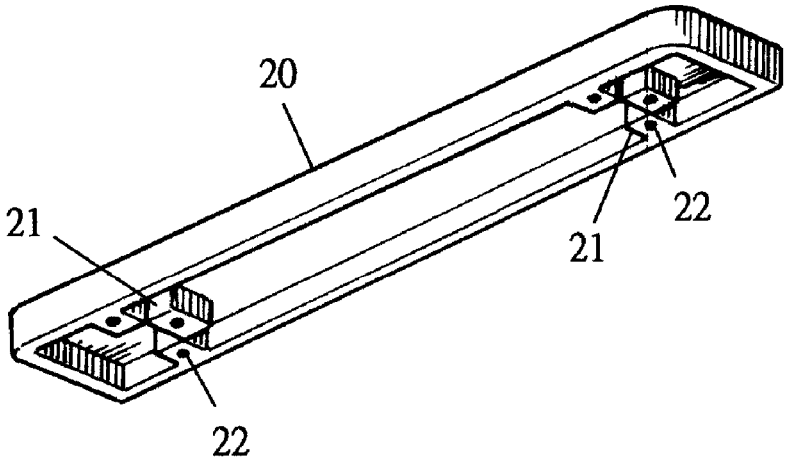
FIG. 2 is a structural perspective view showing a seat plate of the present invention.

Referring to FIG. 2, the seat plate 20 is a rectangular plate. An upper surface of the seat plate 20 is a plane. A plurality of protruding blocks 21 is formed on two ends of a bottom surface of the seat plate 20. A bolt block 22 with an inner thread is embedded to each protruding block 21. The bolt blocks 22 match the plurality of through holes 14 of the sustaining surface 11 of the foot 10.

Figure 3:
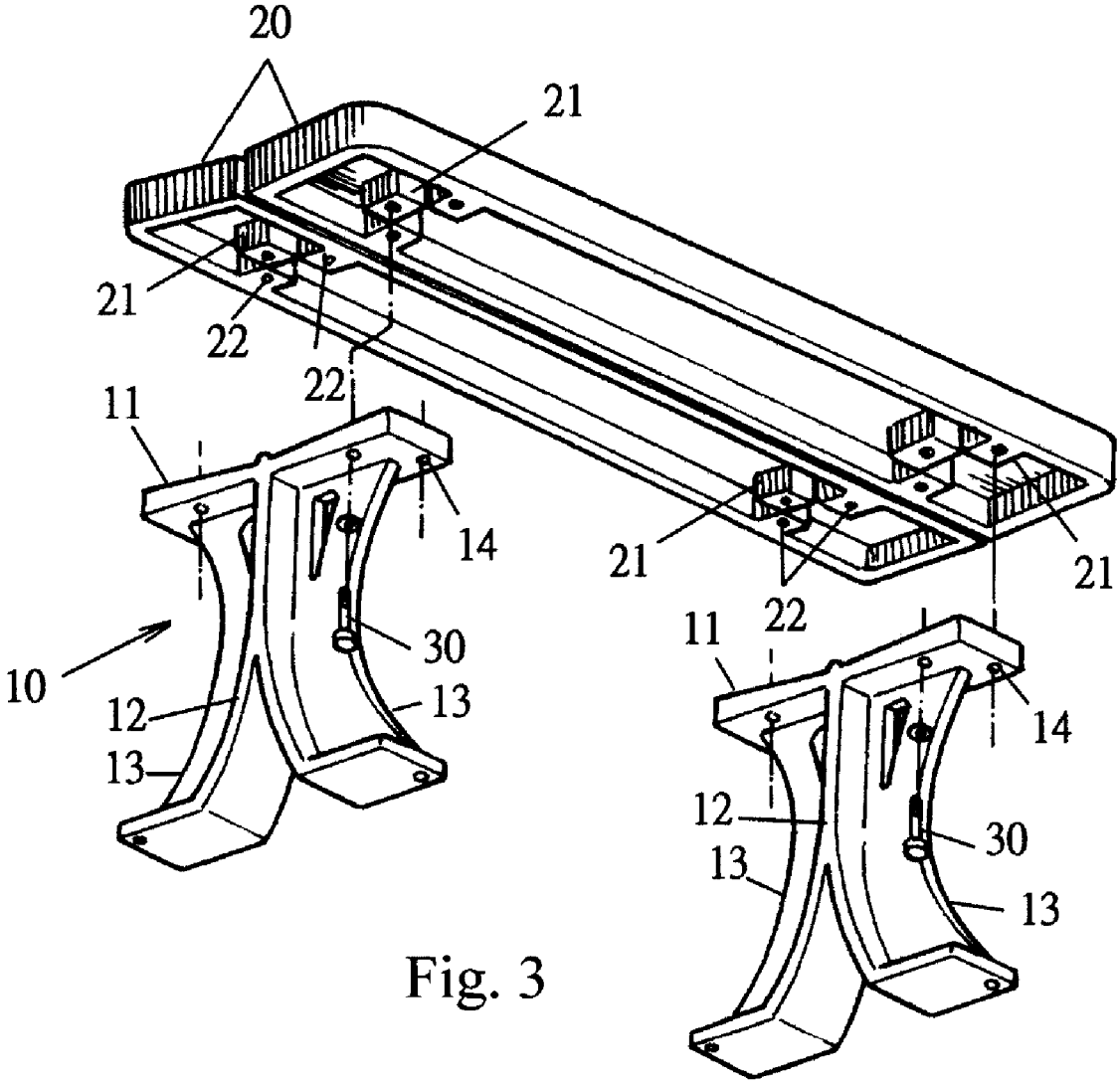
FIG. 3 is an exploded perspective view of the present invention.
Figure 4:
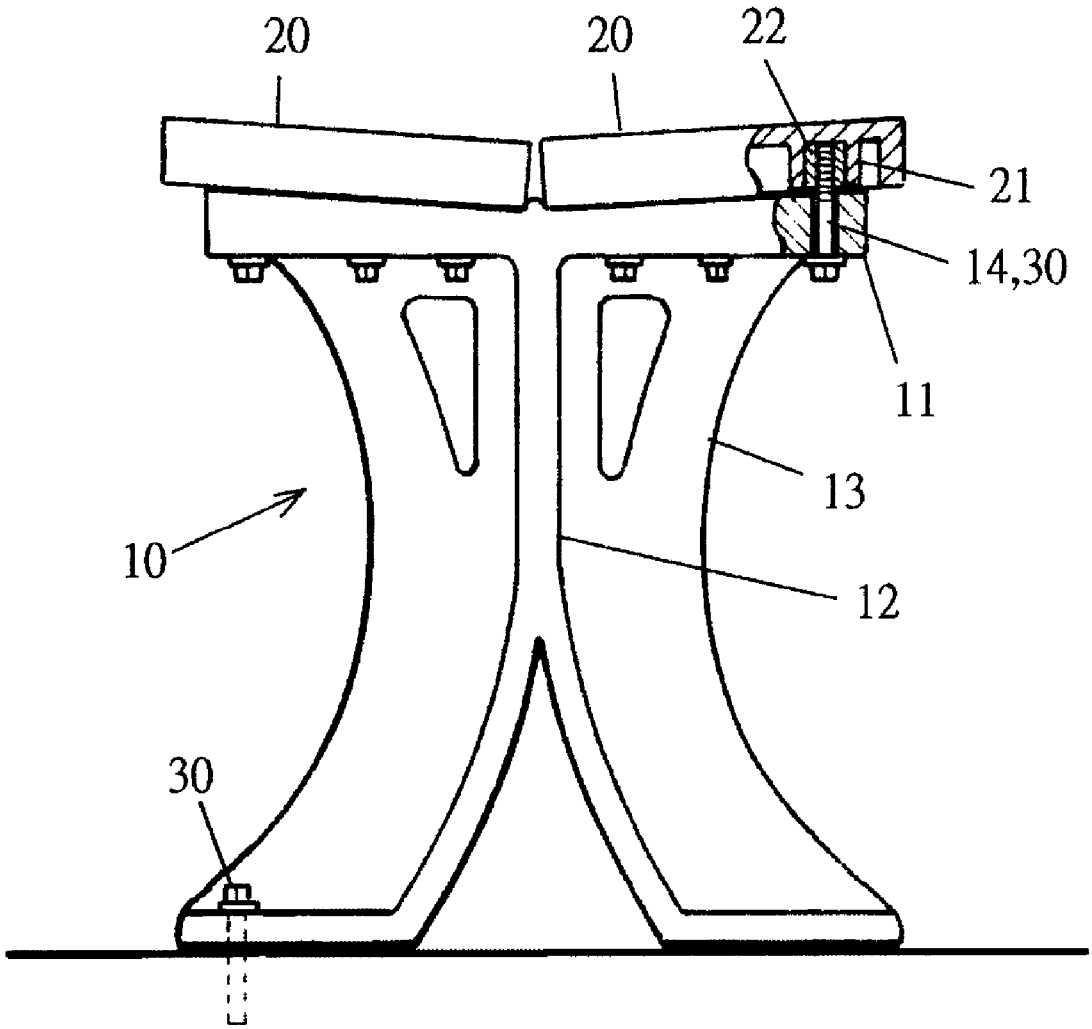
FIG. 4 is a side view with a partially cross sectional view of the present invention.

With reference to FIGS. 3 and 4, the two seat plates 20 are fixed above the two feet 10 by fastening the bolt blocks 22 of the seat plates 20 through the corresponding through holes 14 of the feet 10 with bolts 30. Moreover, the feet 10 can be fixed to the floor by fastening the support frame 12 through the bottom through holes 14 with bolts 30.

Figure 5:
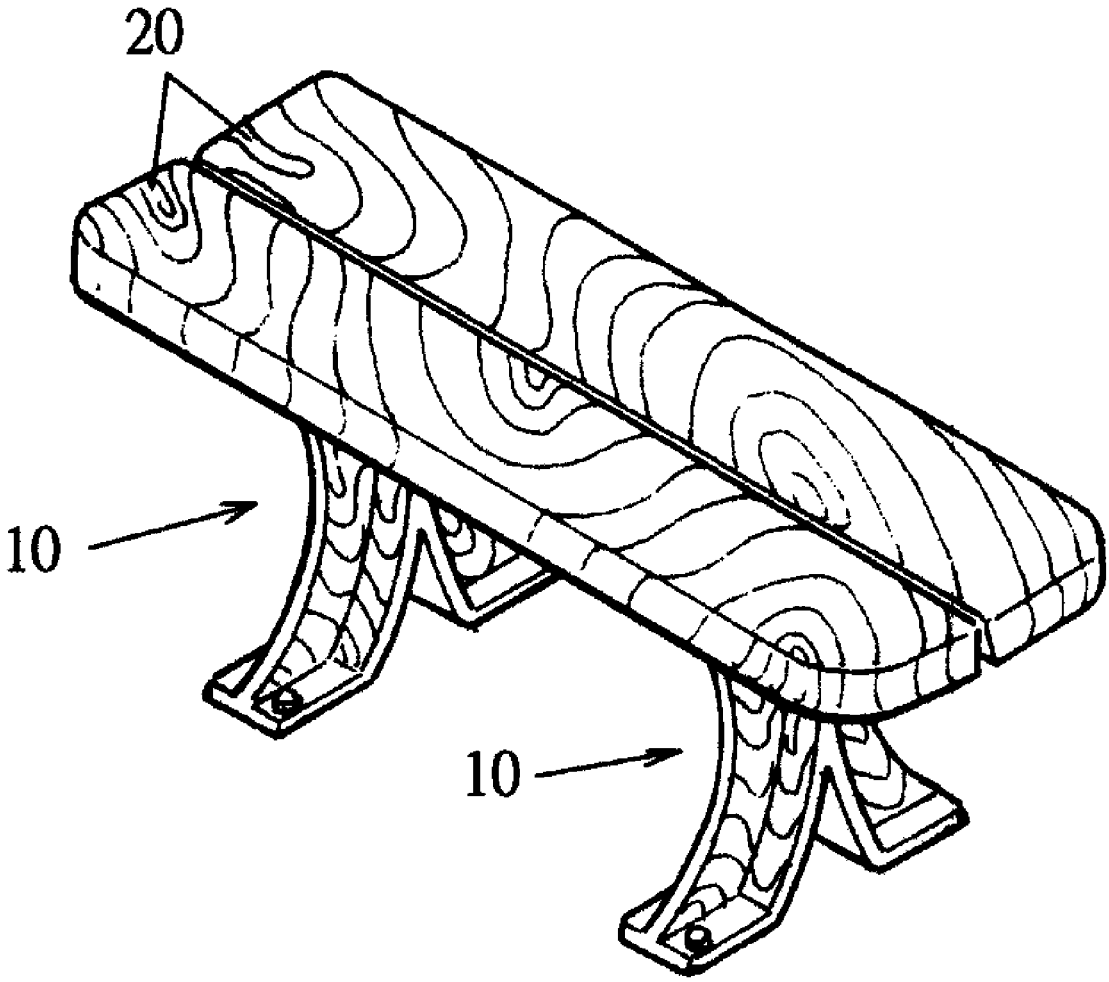
FIG. 5 is a perspective view showing the present invention with a grain of a log.
Figure 6:
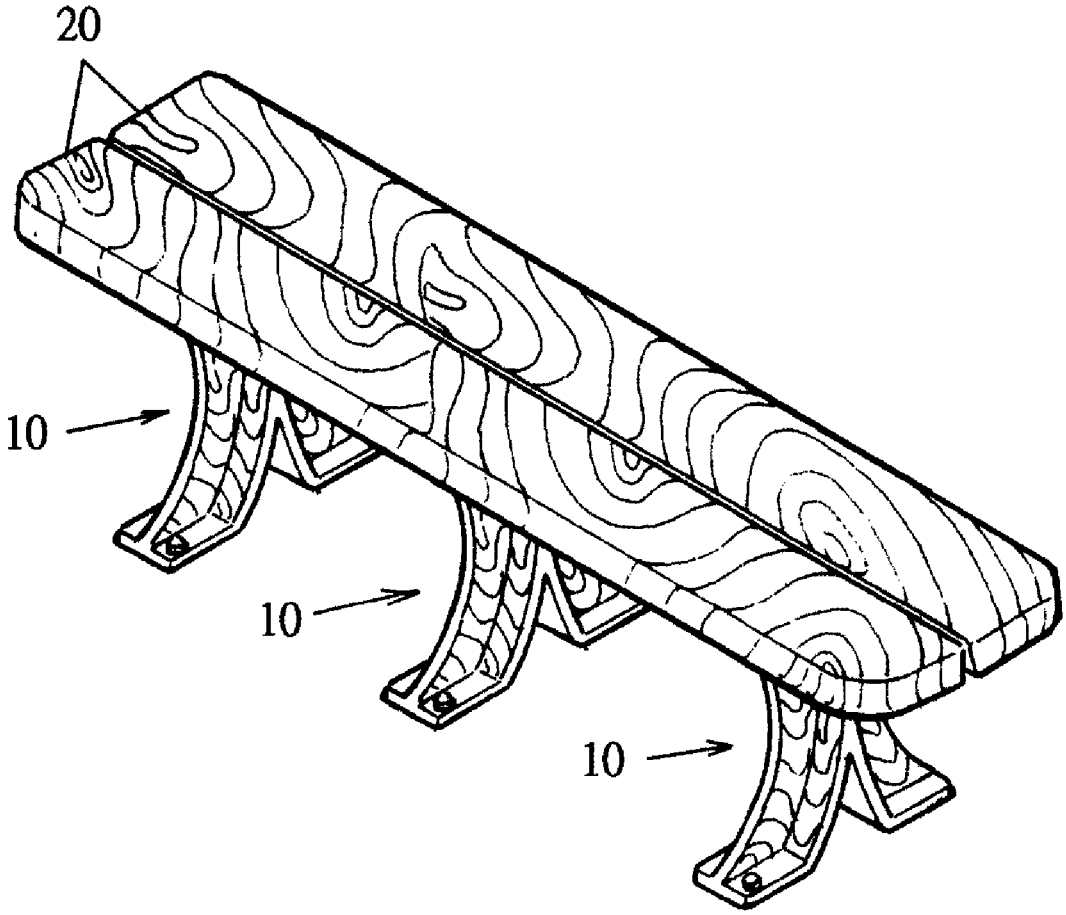
FIG. 6 is a perspective view showing an extended bench of the present invention.

Referring to FIG. 5, the foot 10 and seat plate 20 are made of Polypropylene (PP) and Polyethylene (PE) so that the color and grain are selectable. For example, the feet 10 and the seat plates 20 can be made in brown with wood grain so as to have an approximate appearance of logs. Furthermore, the bench shown in FIGS. 3 to 5 is assembled by two seat plates 20 and two feet 10 (for sitting by two). While in FIG. 6, three feet 10 are engaged to the extended seat plates 20 so that the bench is longer and stronger (for sitting by three).

Therefore, the bench of the present invention has the following advantages.

1. The seat plate 20 is fixed to the foot 10. The support frame 12 below the sustaining surface 11 of the foot 10 and the enhanced sheets 13 on the two sides of the support frame 12 provide a stronger and stable support.

2. The bench provides comfort of sitting by the two seat plates 20 inclining to the center with an angle of the sustaining surface 11 of the feet 10 to avoid sliding.

3. Each foot 10 and each seat plate 20 are formed flat so that they are easy to be packed and stored. It is also easy to assemble for any user by fastening the feet 10 and seat plates 20 with bolts 30.

4. The high polymer material of the foot 10 and seat plate 20 is strong, anti-corrupt, high and low temperature and weather proof, and also recyclable, which is contributive to the environment. Moreover, with a proper color and grain of the bench such as a brown log grain, a better appearance matching the surroundings is provided.

With the present invention thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A bench comprising at least two feet and two seat plates;

each foot and each seat plate being made of Polypropylene (PP) and Polyethylene (PE) and formed separately;

each foot comprising:

a sustaining surface formed on a top of the foot;

the sustaining surface inclined downwards from two outer edges towards a center thereof with a predetermined angle, with the sustaining surface having a width between the two outer edges;

a support frame comprising an inverted Y shape including a trunk having an upper end and a lower end, with the upper end of the trunk formed integrally as one piece with the sustaining surface and extended from a bottom surface at the center of the sustaining surface, with two branches each integrally extending from the lower end of the trunk away from the sustaining surface, with lower ends of the two branches extending away from each other to a spacing generally equal to the width of the sustaining surface;

two enhanced sheets formed as one piece with the foot on two sides of the support frame to improve hardness and load capacity of the foot;

a plurality of through holes formed in the sustaining surface;

each seat plate being a rectangular plate and comprising:

an upper surface of the seat plate being a plane, a plurality of protruding blocks formed on two ends of a bottom surface of the seat plate;

respective bolt blocks, each with an inner thread, the respective bolt blocks embedded in respective protruding blocks;

the bolt blocks matching the plurality of through holes of the sustaining surface of the foot; and the bench comprising bolts fastened through the through holes of the foot to the bolt blocks to fix the foot to the seat plate.

2. The bench as claimed in claim 1, wherein the inclined angle of the sustaining surface of the foot is between 2 to 8 degrees.

* * * * *